US010765167B2

(12) United States Patent
Azoulay et al.

(10) Patent No.: US 10,765,167 B2
(45) Date of Patent: Sep. 8, 2020

(54) TOPLESS SHOE

(71) Applicant: Yehuda Azoulay, Kfar Veradim (IL)

(72) Inventors: Yehuda Azoulay, Kfar Veradim (IL); Olga Grossman, London (GB)

(73) Assignee: Yehuda Azoulay, Kfar Veradim (IL)

( * ) Notice: Subject to any disclaimer, the term of this patent is extended or adjusted under 35 U.S.C. 154(b) by 0 days.

(21) Appl. No.: 15/693,678

(22) Filed: Sep. 1, 2017

(65) Prior Publication Data

US 2017/0360141 A1 Dec. 21, 2017

Related U.S. Application Data

(63) Continuation-in-part of application No. 14/355,370, filed as application No. PCT/IB2012/055231 on Sep. 30, 2012, now abandoned.
(Continued)

(51) Int. Cl.
*A43B 13/14* (2006.01)
*A43B 3/00* (2006.01)
(Continued)

(52) U.S. Cl.
CPC ..... *A43B 3/0036* (2013.01); *A43B 3/10* (2013.01); *A43B 11/00* (2013.01); *A43B 13/12* (2013.01); *A43B 13/141* (2013.01)

(58) Field of Classification Search
CPC ..... A43B 3/0036; A43B 13/16; A43B 13/141; A43B 11/00; A43B 13/222; A43B 13/143
(Continued)

(56) References Cited

U.S. PATENT DOCUMENTS 1,811,781 A 6/1931 Degge
2,677,201 A 5/1954 Lyon
(Continued)

FOREIGN PATENT DOCUMENTS

CA 2 079 929 A1 4/1993
GB 1 245 975 A 9/1971
WO 03/001938 A1 1/2003

OTHER PUBLICATIONS

The Supplementary European Search Report, 2 pages, search completed on Feb. 16, 2016.
(Continued)

*Primary Examiner* — Katharine Gracz
(74) *Attorney, Agent, or Firm* — Vorys, Sater, Seymour & Pease LLP; William Klima

(57) ABSTRACT

A shoe includes a concave body defining sidewalls and a sole of the shoe, and including a first layer received within a second layer. The first layer includes a portion of the sole and upwardly-projecting tabs constituting an inner circumferential wall defining an opening disposed entirely above the sole. The second layer includes a plurality of spaced U-shaped elements each of which includes two walls, forming a portion of an outer circumferential wall, and a bottom, forming a sole-shaped part of the second layer, connecting therebetween. The tabs are characterized by an elasticity that enables them to be pushed outwardly thereby expanding the opening to facilitate receipt of a foot therethrough, and are inwardly-biased thereby being configured to bear upon the foot when received within the cavity, thereby facilitating gripping of the received foot by the shoe.

14 Claims, 8 Drawing Sheets

Related U.S. Application Data

(60) Provisional application No. 61/553,401, filed on Oct. 31, 2011.

(51) Int. Cl.
*A43B 13/12* (2006.01)
*A43B 11/00* (2006.01)
*A43B 3/10* (2006.01)

(58) Field of Classification Search
USPC ..... 36/7.1 R, 8.3
See application file for complete search history.

(56) References Cited

U.S. PATENT DOCUMENTS

| | | | | |
|---|---|---|---|---|
| 2,693,039 | A * | 11/1954 | Balut | A43B 3/101 36/51 |
| 4,542,598 | A | 9/1985 | Misevich et al. | |
| 4,779,360 | A | 10/1988 | Bible | |
| 5,315,767 | A | 5/1994 | Bradbury | |
| 5,682,685 | A | 11/1997 | Terlizzi | |
| D475,180 | S | 6/2003 | Cosentino | |
| 6,578,288 | B2 * | 6/2003 | Bernstein | A43B 3/103 36/106 |
| 6,634,121 | B2 | 10/2003 | Sordi | |
| 6,988,328 | B2 | 1/2006 | Rosen et al. | |
| D558,964 | S | 1/2008 | Truelsen | |
| 8,474,153 | B2 | 7/2013 | Brie et al. | |
| 2001/0005947 | A1 | 7/2001 | Sordi | |
| 2002/0078591 | A1 | 6/2002 | Morrone | |
| 2004/0098881 | A1 | 5/2004 | Flavio et al. | |
| 2005/0066543 | A1 | 3/2005 | Rosen et al. | |
| 2006/0288611 | A1 | 12/2006 | Hogan | |
| 2008/0184592 | A1 | 8/2008 | Brie et al. | |
| 2009/0288314 | A1 | 11/2009 | Kay | |

OTHER PUBLICATIONS

"ToplessShoes Concept by Zhao Xiaoliang, Han Like, Liu Peng, Meng Qingbao, Ren Mingjun, Yang Xiao, Chen Xuan & Lin Lin", TechCracksConcept Design Gallery, last modified on Mar. 1, 2012.
The International Search Report (PCT/ISA/210) for International Application No. PCT/IB2012/055231, 3 pages, dated Feb. 25, 2013.

* cited by examiner

TOPLESS SHOE

FIELD

The invention relates to a topless shoe configured to be conveniently put on.

BACKGROUND

The basic parts of most footwear articles, regardless of their specific type, are a sole and a top part. The sole protects the wearer's foot from direct contact with the ground, while the top part keeps the foot secured to the shoe when the foot is lifted off the ground. In what is often referred to as "closed shoes," the top part covers a substantial portion of the foot, and is normally connected to the sole by a strip of material called a "welt." Sometimes, the welt and the top part are combined. In so-called "open shoes," such as flip-flops or sandals, there is often only minimal structure holding onto the foot or parts thereof from the top. Strings and straps of various types are common examples.

An extreme case of "open shoes" is what is commonly known as "stick on sandals," "stick on flip-flops," etc., in which a sole is attached to the foot solely by adhesive forces. The top surface of these soles exhibits adhesive properties, sufficient to remain clung to the sole of the foot under relatively relaxed walking conditions. A further variation of such sandals is the type which clings to the foot using various suction elements instead of an adhesive.

SUMMARY

There is provided, according to some embodiments, a shoe comprising: a concave body defined by an inwardly-biased circumferential wall having one or more foot securing areas along at least a portion of the circumference of said wall, wherein said one or more foot securing areas are normally inwardly-protruding, so as to secure a foot in said concave body when said shoe is worn, and wherein said one or more foot securing areas have an elasticity which enables said one or more foot securing areas to be pushed outwardly to receive the foot.

In some embodiments, inwardly-protruding comprises said one or more foot securing areas having a vertical-axis differential of approximately 0.1-2 centimeters between an inward-most area and an outwards most area of said wall.

In some embodiments, said one or more foot securing areas extend along at least 50% of the circumference of said wall.

In some embodiments, said one or more foot securing areas extend along at least 70% of the circumference of said wall.

In some embodiments, said concave body consists of a unitary piece of material.

In some embodiments, said concave body comprises: a first layer serving as an insole; and a second layer disposed on an outer surface of said first layer.

In some embodiments, said second layer serves as an outsole.

In some embodiments, said second layer serves as a midsole, and wherein the shoe further comprises a third layer serving as an outsole and being disposed on an outer surface of said second layer.

In some embodiments, said first layer is made at least partially of silicone.

In some embodiments, said first layer is made at least partially of polyethylene foam.

In some embodiments, said second layer is made at least partially of acrylonitrile butadiene styrene (ABS).

In some embodiments, said third layer is made at least partially of silicone.

In some embodiments, said third layer is made at least partially of high-density polyurethane.

There is further provided, according to some embodiments, a shoe comprising a sole-shaped surface having one or more elastic, polymeric foot securing areas along at least 50% of a circumference of said sole-shaped surface, wherein each of said one or more foot securing areas is inwardly-protruding, such that a vertical-axis differential of approximately 0.1-2 centimeters exists between an inward-most area and an outwards most area of said each of said one or more foot securing areas, and wherein said one or more foot securing areas are configured to be pushed outwardly when receiving the foot.

In some embodiments, said one or more foot securing areas extend along at least 70% of the circumference of said sole-shaped surface.

In some embodiments, said one or more foot securing areas extend along at least 90% of the circumference of said sole-shaped surface.

In some embodiments, said sole-shaped surface and said one or more foot securing areas are integrally formed and consist of a unitary piece of material.

In some embodiments, each of said sole-shaped surface and said one or more foot securing areas is made of at least one polymeric material selected from the group consisting of: silicone, polyethylene foam, acrylonitrile butadiene styrene (ABS) and high-density polyurethane.

According to one aspect of the presently disclosed subject matter, there is provided a shoe comprising:

a concave body defining sidewalls and a sole of the shoe, and comprising a first layer received within a second layer, the first layer comprising at least a portion of the sole and a plurality of upwardly-projecting tabs constituting an inner circumferential wall having an upper edge defining an opening, the opening being substantially similar to the sole and being disposed entirely thereabove, and the second layer comprising a plurality of U-shaped elements each of which comprises two walls and a bottom connecting therebetween, each of the two walls forming a portion of an outer circumferential wall of the shoe, and the bottoms forming a sole-shaped part of the second layer, the second layer being disposed on an outer surface of the first layer such that adjacent U-shaped elements are spaced from one another, wherein the tabs are characterized by an elasticity that enables them to be pushed outwardly thereby expanding the opening to facilitate receipt of a foot therethrough, and wherein the tabs are inwardly-biased thereby being configured to bear upon the foot when received within the cavity thereby facilitating gripping of the received foot by the shoe.

The opening may be characterized by substantially the same size, shape, and/or proportions as the sole.

One or more of the tabs may each comprise an inwardly-protruding foot-securing member.

Each of the foot-securing members may extend in a substantially sideways direction.

The shoe may comprise the foot-securing members along a majority of its circumference.

The shoe may comprise the foot-securing members along at least 70% of its circumference.

The first layer may comprise a sole-shaped part, the sole-shaped parts of the first and second layers having different thicknesses at different parts thereof to match the curvature of a plantar surface of one wearing the shoe.

The first layer may consist of a unitary piece of material.

The shoe may further comprise a third layer disposed on an outer surface of the second layer.

The spaces formed between bottoms of adjacent U-shaped elements may match the dynamics of a foot while walking.

The first and second layers may be made of different materials.

The material of the second layer may be more rigid than the material of the first layer.

According to another aspect of the presently disclosed subject matter, there is provided a shoe made of a unitary piece of material comprising:

a sole of the shoe, and a plurality of upwardly-projecting tabs constituting an inner circumferential wall of the shoe and having an upper edge defining an opening, the opening being substantially similar to the sole and being disposed entirely thereabove, wherein the tabs are characterized by an elasticity that enables them to be pushed outwardly thereby expanding the opening to facilitate receipt of a foot therethrough, and wherein the tabs are inwardly-biased thereby being configured to bear upon the foot when received within the cavity thereby facilitating gripping of the received foot by the shoe.

The opening may be characterized by substantially the same size, shape, and/or proportions as the sole.

One or more of the tabs may each comprise an inwardly-protruding foot-securing member.

Each of the foot-securing members may extend in a substantially sideways direction.

The shoe may comprise the foot-securing members along a majority of its circumference.

The shoe may comprise the foot-securing members along at least 70% of its circumference.

It will appreciated that herein the specification and appended claims, the term "inward," "inner," and related terms refers to a direction toward the area defined within the walls of the shoe, i.e., that area into which is foot is placed during use. Similarly, terms relating to a vertical direction (e.g., "up," "upwards," "above," etc.) are to be understood with respect to the orientation in which the shoe is typically arranged during use, i.e., the walls extending upwards from the sole, the cavity within the walls being above the sole, etc.

BRIEF DESCRIPTION OF THE FIGURES

Exemplary embodiments are illustrated in referenced figures. Dimensions of components and features shown in the figures are generally chosen for convenience and clarity of presentation and are not necessarily shown to scale. The figures are listed below.

DETAILED DESCRIPTION

A topless shoe configured to be conveniently put on is disclosed herein. In some embodiments thereof, the shoe is, essentially, a generally sole-shaped concave body, configured, on its own, to secure a wearer's foot inside it. Advantageously, this securing is achieved without any substantial structure to hold on to the foot from above. Instead, the concave body is comprised of a sole defined by an inwardly-biased circumferential wall. The wall has one or more areas (hereinafter "foot securing areas") where it is slightly inwardly-protruding, so as to provide a structurally-minimal but nonetheless effective means of securing the foot in the vertical axis.

The shoe is structured with these foot securing areas being normally in an inwardly-protruding position, while still having a sufficient elasticity to enable them to be pushed outwardly by the foot when the shoe is put on. In a typical scenario, a person wishing to put on the shoe may position his or her foot over it and approximately in alignment with the sole shape of the shoe's body, and then simply push down the foot into the shoe. When the circumferential wall of the shoe is engaged by the descending foot, its foot securing areas are pushed outwards, essentially expanding the circumferential wall and allowing the foot to enter the concave body of the shoe. As the foot passes over the foot securing areas and its lateral pushing of these areas decreases, the areas start to return to their normal, inwardly-protruding position. The foot securing areas finally reach their normal, inwardly-protruding position approximately when the foot is fully down the concave body of the shoe.

When the person starts walking and lifts the foot off the ground, the normally inwardly-protruding foot securing areas prevent the shoe from falling off the foot. Still, the elasticity of these foot securing areas allows for voluntary removal of the shoe, by application for force stronger than the typical downwards force exerted on the shoe naturally when walking. The degree of elasticity of these foot securing areas is carefully designed to this end.

Figure 1:
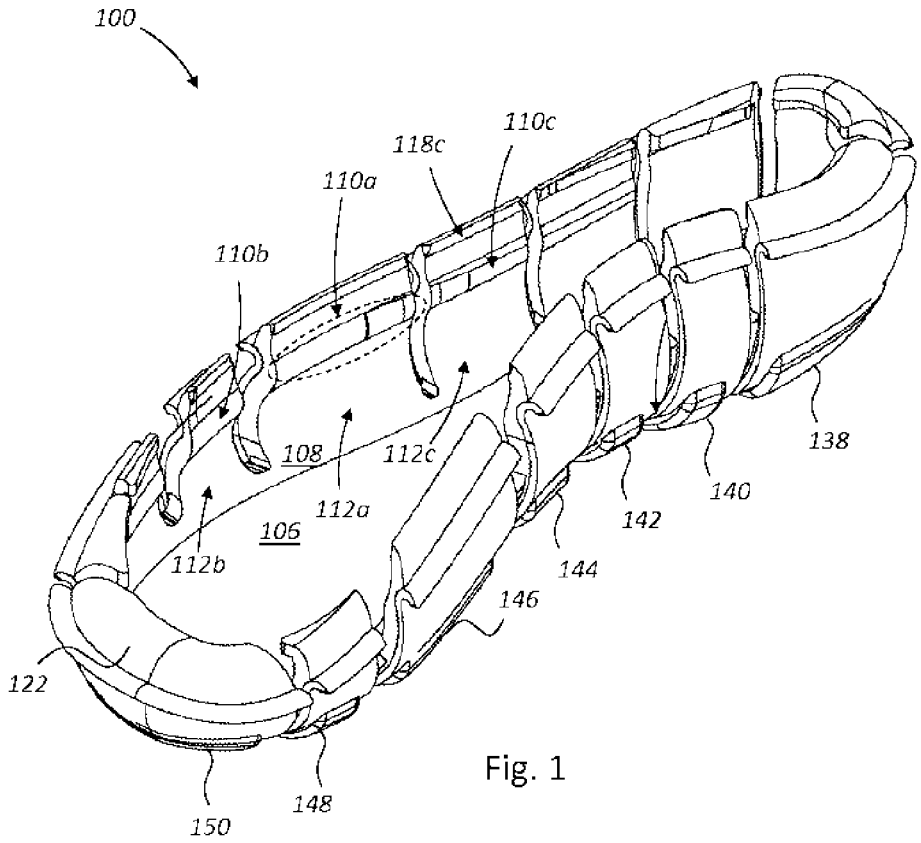
FIG. 1 shows a front isometric view of a shoe, according to some embodiments.
Figure 2:
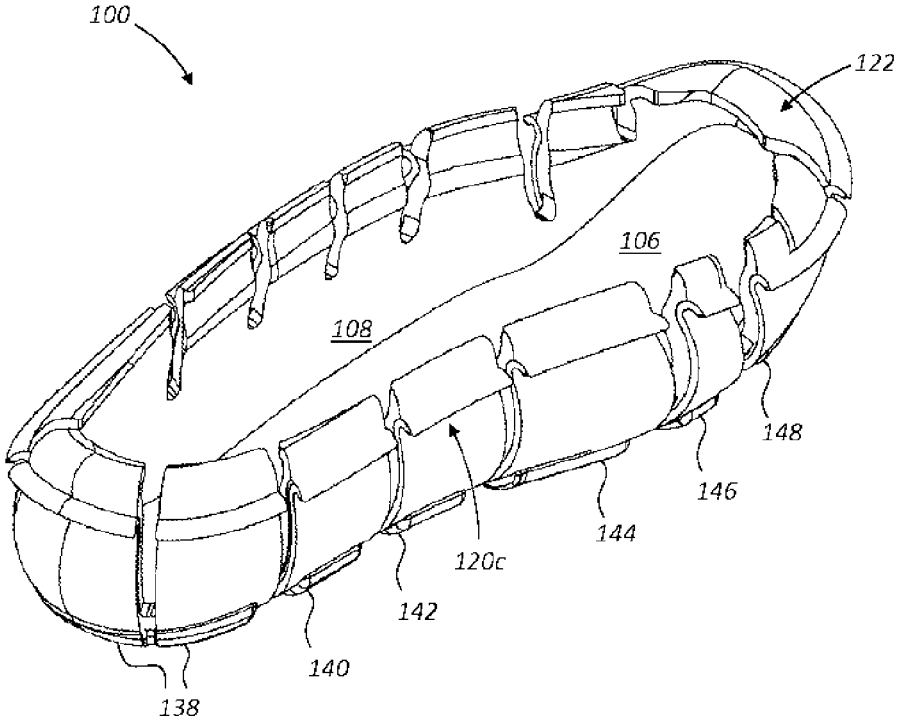
FIG. 2 shows a back isometric view of a shoe, according to some embodiments.
Figure 3:
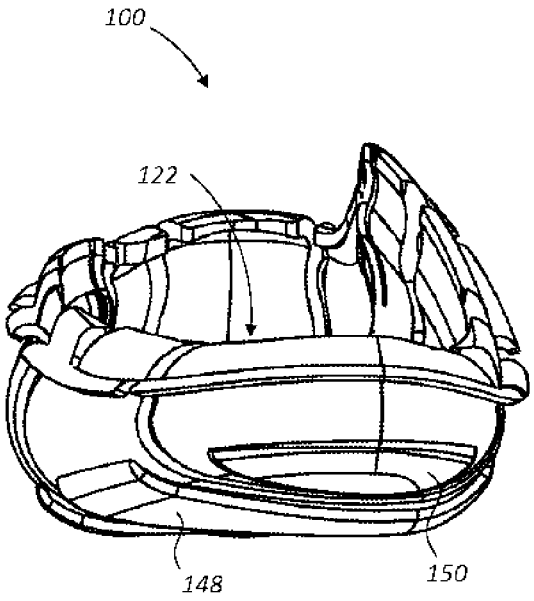
FIG. 3 shows a front planar view of a shoe, according to some embodiments.
Figure 4:
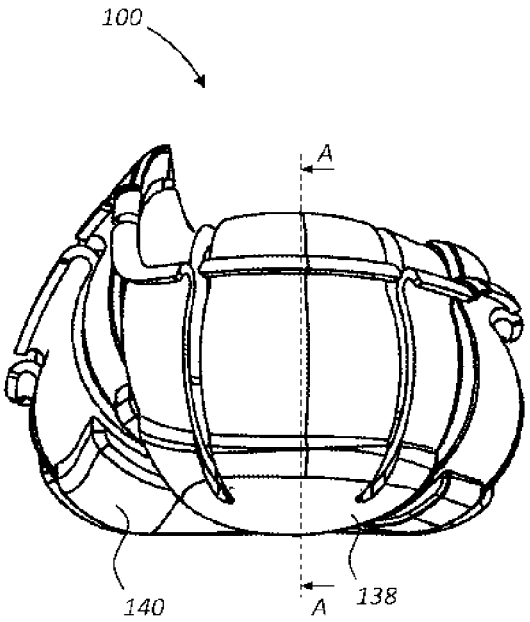
FIG. 4 shows a back planar view of a shoe, according to some embodiments.
Figure 5:
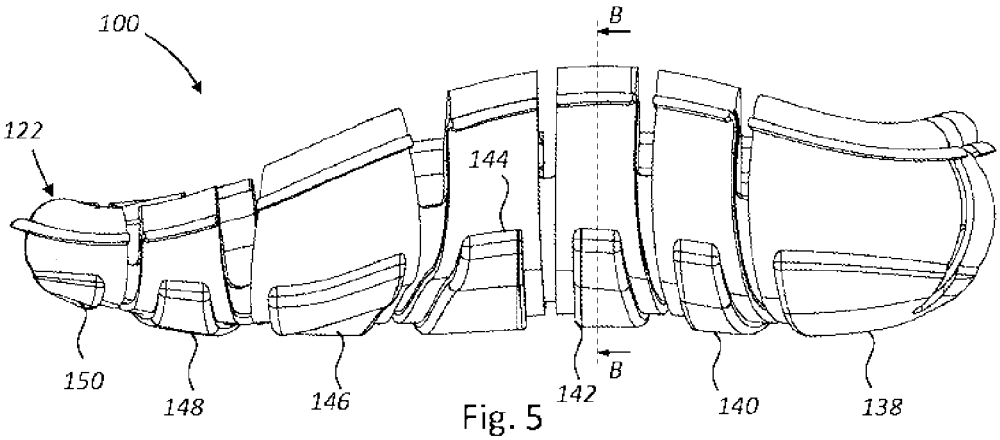
FIG. 5 shows a left planar view of a shoe, according to some embodiments.
Figure 6:
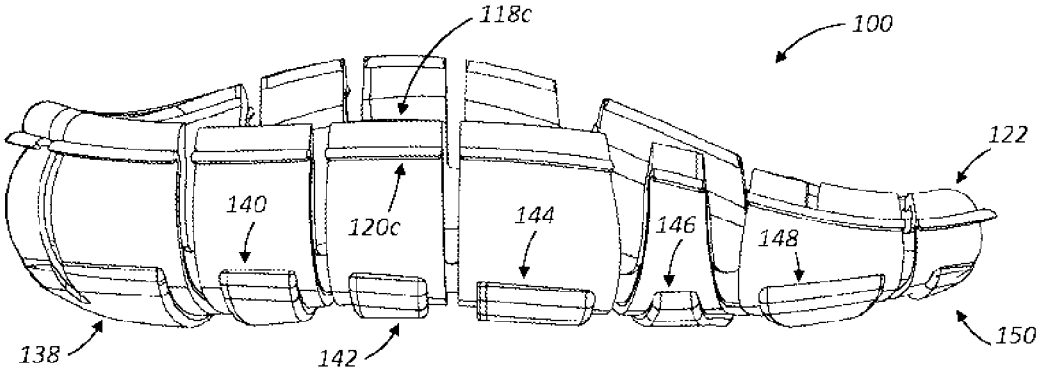
FIG. 6 shows a right planar view of a shoe, according to some embodiments.
Figure 7:
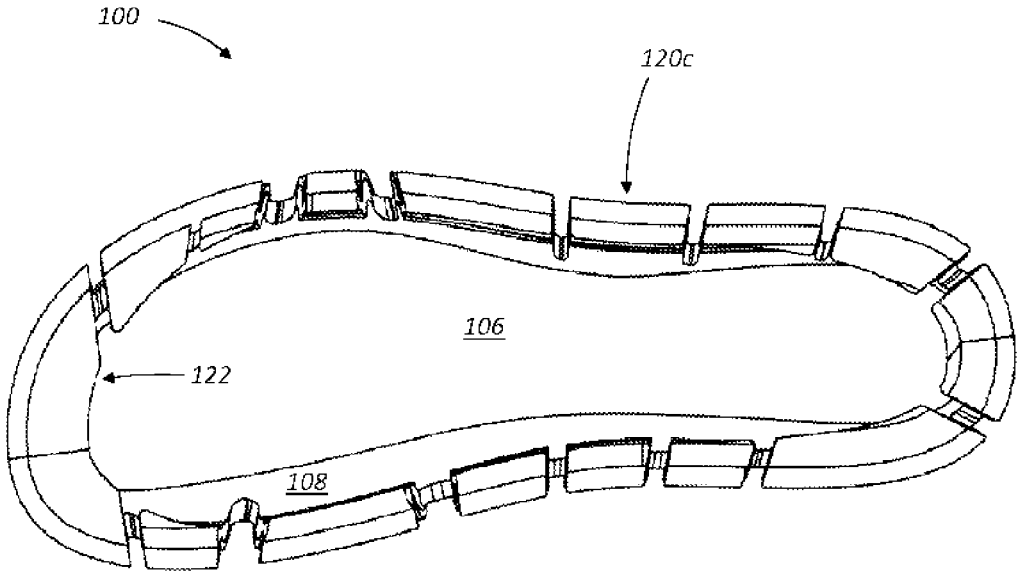
FIG. 7 shows a top planar view of a shoe, according to some embodiments.

Reference is now made to FIGS. 1-2, which show isometric views of an exemplary topless shoe (hereinafter "shoe") 100 from the front and back, respectively. Reference is also made to FIGS. 3-8, which show planar views of shoe 100 from the front, back, left, right, top and bottom, respectively, as well as to FIGS. 9-10 which show longitudinal (A) and latitudinal (B) cross-sections of the shoe, respectively. For reasons of simplicity, the figures depict a right shoe, but are naturally intended to apply also to a left shoe, mutatis mutandis.

As shown in the figures, shoe 100 may include three layers: a first layer 102, e.g., serving as an insole, a second layer 104, e.g., serving as a midsole, and a third layer 106, e.g., serving as an outsole. In a different embodiment (not shown), however, a shoe may include only a single layer, while having a shape similar to that of the embodiment of the figures. In a further embodiment (not shown), a shoe may include two layers, while having a shape similar to that of the embodiment of the figures. In yet another embodiment (not shown), a shoe may include four or more layers, while a shape similar to that of the embodiment of the figures. In the presently disclosed subject matter, the term "sole" will be used to refer to all of these layers collectively. Those of skill in the art will recognize, based on the former and following discussions, that all of the aforementioned, non-showed embodiments have multiple configurational aspects in common, despite being structured with a different number of layers and/or parts. Exemplary aspects are the one or more foot securing areas which only minimally protrude inwardly. Such aspects endow these embodiments with advantageous qualities, such as the ability to secure a foot without any substantial structure to hold on to the foot from above, as discussed.

Returning to the figures, the first layer 102 may have a generally sole-shaped concave body, made of at least a sole-shaped part (or "surface") 106 and an inwardly-biased circumferential wall 108 which defines the concave body. The wall 108 may be divided, up to at least a portion of its height, into tabs, such as tabs 112*a-c*, defining a plurality of vertical slots therebetween. Sole-shaped part 106 and rim 108 may be unitarily formed, such as by injection molding, or be two separate parts attached together. The wall 108 may be structured as a circumferential wall encompassing sole-shaped part 106. The wall 108 is intended, inter alia, to provide lateral support to the foot, somewhat similar to a welt of a conventional shoe. However, in contrast to many conventional shoes, the wall 108 is additionally configured, advantageously, to secure the foot vertically, without the need for substantial structures such as straps or strings that cover parts of the foot from above. This may be achieved by virtue of one or more foot securing areas, such as a representative foot securing area 110*a*, shown encircled in FIG. 1 for demonstration reasons. Foot securing area 110*a* is, essentially, an inwardly-protruding member of tab 112*a*; the wall 108 may be divided, across at least a portion of its height, into multiple tabs, such as tabs 112*a-c* and the like. By having one or more foot securing areas, such as 110*a-c*, inwardly protruding relative to lower areas of their associated tabs, such as tabs 112 *a-c*, the sides of the foot may snugly fit into these lower areas of the tabs and at the same time be secured from above using the inwardly-protrusion of the foot securing areas. Foot securing areas of a shoe, such as shoe 100, optionally extend along a substantial portion of the circumference of the shoe, such as at least 50%, 70% or 90%, of the circumference. The degree of securing is usually a factor of the circumferential portion occupied by foot securing areas, versus the amount of inwardly protrusion of these areas. Generally, the more protruding these areas are, the less of them is required, and vice versa. The foot securing areas 110*a-c*, in accordance with some embodiments, may inwardly protruding to a only a minimal degree, i.e., such that the shoe 100 is essentially "topless", and therefore extend along a substantial portion of the shoe's circumference, as discussed above.

The shoe 100, according to any of the embodiments described or otherwise encompassed by the scope of the disclosure, is open over a majority of the area above the sole thereof, for example as defined by the first layer 102, i.e., an upper edge of the wall 108 at an uppermost edge of the shoe defines an opening which is formed substantially similar to the sole, e.g., being of similar proportions, size, and/or shape thereof. It will be appreciated that the opening may be formed such that it is not exactly similar to the insole, for example owing to inwardly-projecting foot-securing areas 110*a-c*, frontal parts 122 (discussed below) which function as a toe protector, etc., which still falling within the scope of being formed substantially similar to the sole. The opening may be disposed above the sole, for example such that is lies substantially in registration therewith (i.e., wherein corresponding parts of its shape are disposed above analogous parts of the shape of the sole).

Figure 10:
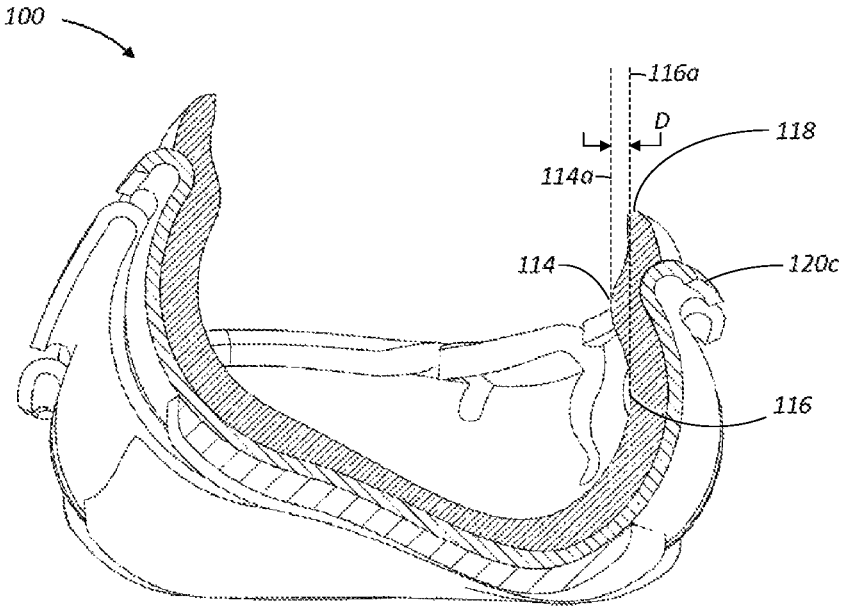
FIG. 10 shows a latitudinal cross sectional view of a shoe, according to some embodiments.

In some embodiments, there is a vertical-axis differential between one or more of the foot securing areas 110*a-c* and their associated lower parts of tabs 112*a-c*. For better illustration, the cross section in FIG. 10 shows two points: a innermost point 114 of foot securing area 112*c*, and an outermost point 116 of a lower area of tab 112*c* (which may simply be referred to as the outermost point of the tab). A vertical-axis differential D is marked between a vertical axis 114 a on which innermost point 114 resides, and between a vertical axis 116 a on which outermost point 116 resides. D may have different measurements at different circumferential areas of the wall 108, to fit the foot's anatomy. This may both enhance the comfort of shoe 100 to its wearer, and enhance the shoe's securing of the foot. Generally, frontal parts of the foot, such as its dorsal surface, which are farther away from the foot's connection to the leg, may require securing using a larger D since they have a substantial lateral curvature. In contrast, posterior parts of the foot, such as around the heel bone, may generally require securing using a smaller D; in some persons, however, parts surrounding the heel bone may sometimes lack a substantial lateral curvature, so that D may be very small or even zero. Furthermore, in some embodiments, some areas of the wall may extend higher up than others, to match the natural curvature of the foot's sides.

In some embodiments, D may measure between approximately 0.1-3 centimeters, depending on the foot part, as discussed above. In some other embodiments, D may measure between approximately 0.1-2 cm, 0.2-2 cm, 0.3-2 cm, 0.4-2 cm, 0.5-2 cm, 0.6-2 cm, 0.7-2 cm, 0.8-2 cm, 0.9-2 cm, 1-2 cm, 1.1-2 cm, 1.2-2 cm, 1.3-2 cm, 1.4-2 cm, 1.5-2 cm, 1.6-2 cm, 1.7-2 cm, 1.8-2 cm or 1.9-2 cm, for example depending on the foot part, the shoe size and/or the like. In further embodiments, D may exceed the aforementioned measurements.

The division of the wall 108 into tabs, such as tabs 112*a-c*, is optional. Tabs 112*a-c* may purposely weaken the wall 108 structurally, so it may be conveniently pushed outwards by the foot when shoe 100 is put on. Generally, using more rigid materials for the wall, the first layer and/or the second layer, may necessitate more tabs, while little or no tabs may be needed when more elastic materials are used—since the material elasticity, on its own, may be sufficient to allow the wall to widen to receive the foot. In present embodiments, D and the rigidity/elasticity of the materials, have been carefully chosen and correlated in order to provide a functionally-beneficial tradeoff between a size of a top structure of shoe 100, which is desired to be minimal, and the ability of such structure to secure the foot sufficiently.

The second layer 104 may be attached to the first layer 102 externally, such as by glue, melting and/or the like, and the interface between the two may follow the same (or a similar) curvature and shape along a substantial part of their area or even its entirety. Hence, the above discussion of the first layer 102 applies, mutatis mutandis, to the second layer 104. It is intended that similarly-shaped elements of the second layer 104 shall be referred to using the same terminology of their respective elements in of the first layer 102.

In other embodiments (not shown), functions of the first layer and the second layer may be materialized using a single layer serving both purposes, as discussed above. In the exemplary embodiment of the figures, the first layer plus the second layer structure is adopted in order to combine comfort characteristics of the first layer 102 with more technical-functional characteristics of the second layer 104.

The structure of the second layer 104 may depart from that of the first layer 102 in some parts thereof. One of the differences between the first layer 102 and the second layer 104 may be, for example, their manufacturing from different materials. While the first layer 102, which comes in contact with the wearer's foot, may be made of a comfortable, soft and/or antimicrobial material(s), the second layer 104 may be made of a more rigid material(s). By way of example, the first layer 102 may be made at least partially of one or more of silicone, polyethylene foam, another polymeric material, a non-polymeric material or any combination thereof. The thickness of the first layer 102 or parts thereof, according to some embodiments, may be in the range of 0.2 cm to 1.5 cm. In other embodiments, the thickness of the first layer 102 or parts thereof may be higher than 1.5 cm.

The second layer 104 may be made, for instance, at least partially of one or more of acrylonitrile butadiene styrene (ABS), another polymeric material, a non-polymeric material or any combination thereof. The thickness of the second layer 104 or parts thereof, according to some embodiments, may be in the range of 0.2 cm to 1.5 cm. In other embodiments, the thickness of the second layer 104 or parts thereof may be higher than 1.5 cm.

As a further example, the first layer 102 and the second layer 104 may differ in the configuration of a top area of their walls. With reference to the cross section of FIG. 9, tab 110*c* (and optionally other tabs) of the first layer 102 may include a top area 118*c* above foot securing area 112*c*. Top area 118*c* extends between innermost point 114 and an edge 118, wherein the edge is disposed outwardly relative to innermost point 114. The wall 108 essentially becomes wider above innermost point 114. This widening allows for easy entry of the foot into shoe 100. When the foot contacts top area 118*c* and continues to be pushed down, tab 112*c* is pushed outwards. Optionally, edge 118 is vertically-aligned, exactly or approximately, with outermost point 116. Since the location of outermost point 116 is set to accommodate the foot's width, edge 118 has to be positioned at least on the same vertical axis as the outermost point, if not farther outwardly, in order for it to be wide enough to receive the foot.

Yet another example is that the division of the wall 108 of the first layer 102 into tabs does not necessarily correspond to a similar division of the second layer 104. For example, two or more adjacent tabs of the first layer 102 may extend over a single tab of the second layer 104, or vice versa. Namely, the structural weakening of shoe 100 using tab division may be performed in only part of the layers of the shoe, and only in certain area(s).

As to the second layer 104, a top area 120*c* thereof does not, in some embodiments, need to come in contact with the foot when shoe 100 is put on. Therefore, top area 120*c* may be structured in such a way that it just supports top area 118*c* of inner sole 102. Top area 120*c* may be structured, for example, as an outwards-curling part, which reinforces top area 118*c* from outside.

A sole-shaped part 106 of the first layer 102, and that of the second layer 104, may have different thicknesses across different parts thereof, in order to match the natural curvature of the foot's plantar surface. For example, greater thickness may be provided beneath the arches of the foot, and lower thickness may be disposed beneath the heel bone and the forefoot.

A frontal part of shoe 100, which is generally referenced as 122, optionally lacks foot securing areas. Instead, frontal part 122 may be shaped as a toe protector, covering the toes or a part thereof. Frontal part 122 is optionally made of an extension of the first layer 102. Since the toes are flexible, as opposed to other parts of the foot, a foot securing area in front of the toes is usually inefficient—the toes can easily escape it. Therefore, toe protection may be provided by frontal part 122, or, in other embodiments (not shown), a frontal part of a shoe may lack such a cover altogether. Even if a cover exists, it may be structured and positioned such that there is a vertical gap between it and the toes when the shoe is worn; namely, it may not serve to secure the foot in place.

Figure 8:
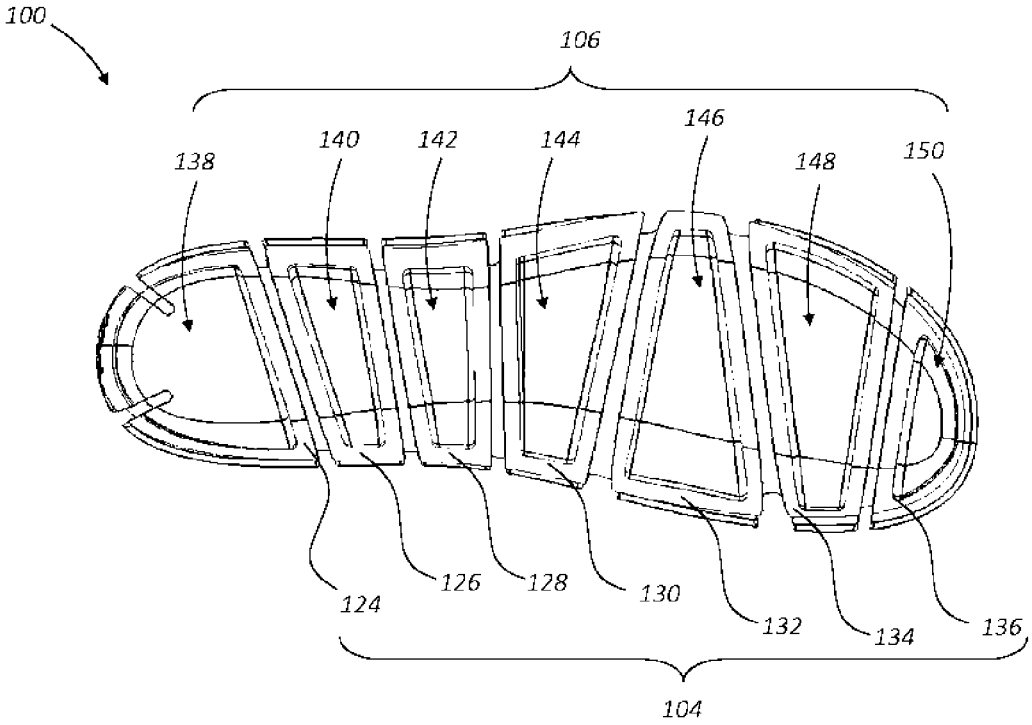
FIG. 8 shows a bottom planar view of a shoe, according to some embodiments.
Figure 9:
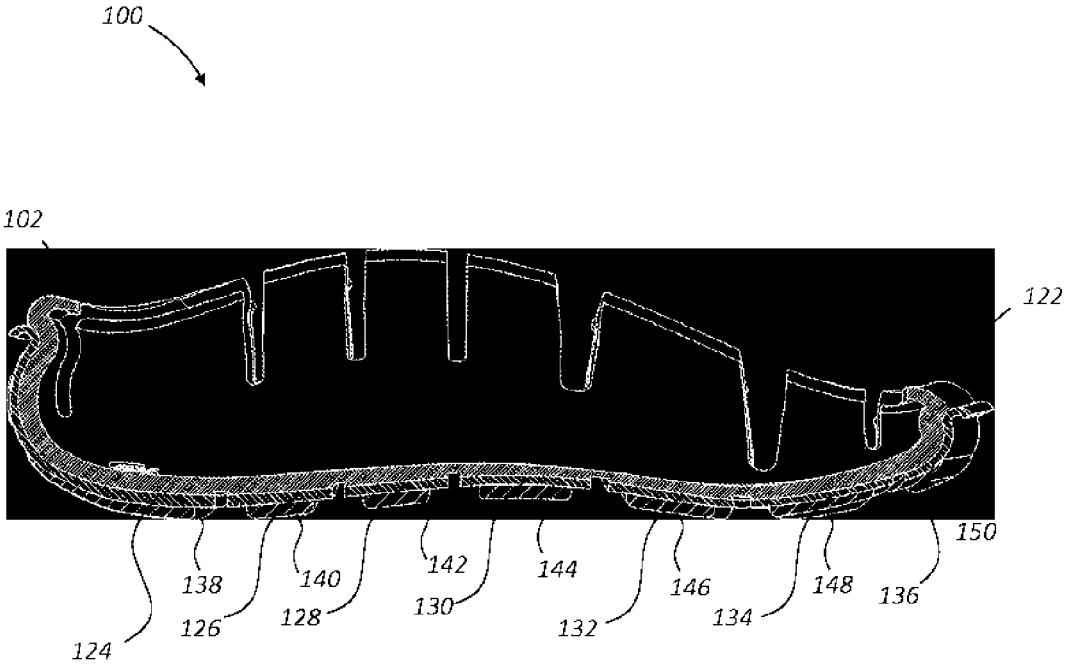
FIG. 9 shows a longitudinal cross sectional view of a shoe, according to some embodiments.

A further difference between the first layer 102 and the second layer 104 may be, for example, the extension of tabs of the second layer further down from tabs 112*a-c* of the first layer. This is best depicted in FIG. 8, which shows shoe 100 from a bottom view. This depiction relates to some embodiments, in which the second layer 104 is actually made up of a plurality of separate U-shaped elements, such as elements 124-136, wherein the walls of the U-shape are the inwardly-biased circumferential wall of the second layer, and the bottom of the U-shape is the sole-shaped part of the second layer. Optionally, at least the bottoms of at least some of the U-shaped elements of the second layer 104, such as elements 124-136, are separated and attached to the first layer 102 in such locations, that the spaces formed between the elements match the dynamics of the foot when walking. This, as opposed to many conventional shoes in which the soles are only minimally-flexible and usually have the same degree of flexibility along their areas. When the bottoms of at least some of elements 124-136 are separated, as shown in the figure, shoe 100 in general gives its wearer a feeling close to the feeling of walking barefoot. The natural, dynamic motion of different parts of the foot is only minimally affected due to the separation. The specific shapes and separation of elements 124-136 depicted in FIG. 8, have been experimentally tested and verified to correspond to the dynamic motion of different parts of the foot. However, this is only one of multiple embodiments of the invention, and other shapes and separation of elements are intended within the framework of different embodiments. In contrast to the separation of U-shaped elements, in other embodiments (not shown), the second layer or parts thereof may be integrally formed.

The third layer 106, which is also an optional layer, may include pieces, such as pieces 138-150, attached to elements 124-136, respectively, externally. The third layer 106 may be made of a highly-durable material, allowing it to last throughout prolonged use. One example of a suitable material is high-density polyurethane, but other materials are possible as well. In other embodiments (not shown) the shoe may be provided without the third layer, and a the second layer may be made of a material(s) suitable both for supporting the first layer and durably interfacing with the ground.

As alluded to above, the shoe 100, according to some examples, may comprise only the first layer 102, as described above, without the second or third layers 104, 106. It may be made from any suitable material, for example a polymer or mix thereof having both thermoplastic and elastomeric properties such as thermoplastic elastomers or rubbers, from thermoplastic polyurethane, etc.

In the description and claims of the application, each of the words "comprise" "include" and "have," and forms thereof, are not necessarily limited to members in a list with which the words may be associated. In addition, where there are inconsistencies between this application and any document incorporated by reference, it is hereby intended that the present application controls.

Those skilled in the art to which this invention pertains will readily appreciate that numerous changes, variations, and modifications can be made without departing from the scope of the presently disclosed subject matter, mutatis mutandis.

The invention claimed is:

1. A shoe comprising:

a concave body defining sidewalls and a sole of the shoe, and comprising a first layer received within a second layer, said first layer comprising at least a portion of said sole and a plurality of circumferentially adjacent upwardly-projecting tabs constituting an inner circumferential wall surrounding said sole and having an upper edge at an uppermost portion of the shoe and defining an opening, said opening having a shape substantially similar to that of the sole and being disposed entirely thereabove, said tabs being spaced from one another so as to define a plurality of vertical slots between adjacent tabs, and said second layer comprising a plurality of U-shaped elements each of which comprises two walls and a bottom connecting therebetween, each of said two walls forming a portion of an outer circumferential wall of the shoe, and said bottoms forming a sole-shaped part of the second layer, said second layer being disposed on an outer surface of said first layer such that adjacent U-shaped elements are spaced from one another thereby defining a plurality of vertical slots between adjacent U-shaped elements, wherein said tabs are characterized by an elasticity that enables them to be pushed outwardly thereby expanding said opening to facilitate receipt of a foot therethrough, and wherein said tabs are inwardly-biased thereby being configured to bear upon said foot when received within the cavity thereby facilitating gripping of the received foot by the shoe.

2. The shoe according to claim 1, wherein said opening is characterized by substantially the same size, shape, and/or proportions as the sole.

3. The shoe according to claim 1, one or more of said tabs each comprising an inwardly-protruding foot-securing member.

4. The shoe according to claim 3, wherein each of said foot-securing members extends in a substantially sideways direction.

5. The shoe according to claim 3, comprising said foot-securing members along a majority of the shoe circumference.

6. The shoe according to claim 5, comprising said foot securing members along at least 70% of the shoe circumference.

7. The shoe according to claim 1, wherein said first layer comprises a sole-shaped part, the sole-shaped parts of said first and second layers have different thicknesses at different parts thereof to match the curvature of a plantar surface of one wearing the shoe.

8. The shoe according to claim 1, wherein said first layer consists of a unitary piece of material.

9. The shoe according to claim 1, further comprising a third layer disposed on an outer surface of said second layer.

10. The shoe according to claim 1, wherein said spaces formed between bottoms of adjacent U-shaped elements match the dynamics of a foot while walking.

11. The shoe according to claim 1, wherein said first and second layers are made of different materials.

12. The shoe according to claim 11, wherein the material of said second layer is more rigid than the material of said first layer.

13. The shoe according to claim 1, wherein a first lateral portion of the inner circumferential wall is opposed to a second lateral portion of the inner circumferential wall, wherein first lateral portion of the inner circumferential wall has a first series of said upwardly-projecting tabs, wherein second lateral portion of the inner circumferential wall has a second series of said upwardly-projecting tabs, wherein the upwardly-projecting tabs define a plurality of gaps along the shoe circumference, each said gap respectively between adjacent upwardly-projecting tabs.

14. A shoe comprising:

a concave body defining sidewalls and a sole of the shoe, and comprising a first layer received within a second layer, said first layer comprising at least a portion of said sole and a plurality of circumferentially adjacent upwardly-projecting tabs constituting an inner circumferential wall surrounding said sole and having an upper edge at an uppermost portion of the shoe and defining an opening, said upper edge having a shape substantially similar to that of the sole and being disposed entirely thereabove, said tabs being spaced from one another so as to define a plurality of vertical slots between adjacent tabs, and said second layer comprising a plurality of U-shaped elements each of which comprises two walls and a bottom connecting therebetween, each of said two walls forming a portion of an outer circumferential wall of the shoe, and said bottoms forming a sole-shaped part of the second layer, said second layer being disposed on an outer surface of said first layer such that adjacent U-shaped elements are spaced from one another thereby defining a plurality of vertical slots between adjacent U-shaped elements, wherein said tabs are characterized by an elasticity that enables them to be pushed outwardly thereby expanding said opening to facilitate receipt of a foot therethrough, and wherein said tabs are inwardly-biased thereby being configured to bear upon said foot when received within the cavity thereby facilitating gripping of the received foot by the shoe.

* * * * *